US008336116B2

(12) United States Patent
Seguin et al.

(10) Patent No.: US 8,336,116 B2
(45) Date of Patent: Dec. 25, 2012

(54) GARMENT CLOSURE SYSTEM

(76) Inventors: Angela Jodie Gomes Seguin, Belle River (CA); Marc A. Bay, Farmington Hills, MI (US)

( * ) Notice: Subject to any disclaimer, the term of this patent is extended or adjusted under 35 U.S.C. 154(b) by 1157 days.

(21) Appl. No.: 12/111,019

(22) Filed: Apr. 28, 2008

(65) Prior Publication Data

US 2009/0265829 A1 Oct. 29, 2009

(51) Int. Cl.
*A41D 3/04* (2006.01)

(52) U.S. Cl. ..... 2/67; 2/96

(58) Field of Classification Search ..... 2/92, 93, 2/96, 97, 87, 94, 455, DIG. 1
See application file for complete search history.

(56) References Cited

U.S. PATENT DOCUMENTS

| | | | | |
|---|---|---|---|---|
| 317,711 | A | 5/1885 | Brinkmann | |
| 367,921 | A | 8/1887 | Norton | |
| 375,504 | A | 12/1887 | Norton | |
| 385,306 | A | 6/1888 | Helwitz | |
| 984,180 | A * | 2/1911 | Barker | 2/87 |
| 1,015,231 | A | 1/1912 | Jacobs | |
| 1,164,386 | A | 12/1915 | Nicholas | |
| 1,223,863 | A | 4/1917 | Freedman | |
| 1,246,274 | A | 11/1917 | Jelalian | |
| 1,250,004 | A | 12/1917 | Philip | |
| 1,269,019 | A | 6/1918 | Szmyt | |
| 1,359,999 | A | 11/1920 | McEvoy | |
| 1,360,390 | A | 11/1920 | Gilfillan | |
| 1,363,981 | A | 12/1920 | Jenkins et al. | |
| 1,381,373 | A | 6/1921 | Waterman | |
| 1,518,884 | A | 12/1924 | Weiner | |
| 1,647,656 | A | 11/1927 | Olsen | |
| 1,648,282 | A | 11/1927 | Schneider | |
| 1,679,102 | A | 7/1928 | Thompson | |
| 1,693,464 | A | 11/1928 | Quantz | |
| 1,714,491 | A | 5/1929 | Burr | |
| 1,721,403 | A | 7/1929 | Miller | |
| 1,782,000 | A | 11/1930 | Collins | |
| 1,818,811 | A | 8/1931 | Miller | |
| 1,971,622 | A | 8/1934 | Quackenbush | |
| 1,973,421 | A | 9/1934 | Wallace | |
| 2,010,328 | A | 8/1935 | Siebrandt | |
| 2,010,434 | A | 8/1935 | Langrock | |
| 2,073,711 | A | 3/1937 | Robinsohn | |

(Continued)

FOREIGN PATENT DOCUMENTS

| | | |
|---|---|---|
| BE | 494309 | 3/1950 |

(Continued)

OTHER PUBLICATIONS

"Fieldsheer Air Speed Jacket", Advertisement from Parts & Accessories, MOTORCYCLEVILLE.COM, Year 2001 Model, (published Feb. 8, 2003) 1 page.

(Continued)

*Primary Examiner* — Khoa Huynh
*Assistant Examiner* — Anna Kinsaul
(74) *Attorney, Agent, or Firm* — JWIP & Patent Services, LLC; Jacob G. Weintraub, Esq.

(57) ABSTRACT

A garment having a ventilated garment closure system including a vented zipper is provided. A first flap is disposed on a first side of a vented zipper, and a second flap disposed on a second side of the vented zipper.

21 Claims, 4 Drawing Sheets

U.S. PATENT DOCUMENTS

| | | | | |
|---|---|---|---|---|
| 2,078,461 | A | | 4/1937 | Siegel |
| 2,079,980 | A | | 5/1937 | Anders |
| 2,084,173 | A | | 6/1937 | Wexler |
| 2,114,514 | A | | 4/1938 | York |
| 2,119,621 | A | | 6/1938 | Ferrone |
| 2,148,269 | A | * | 2/1939 | Koch ..... 2/74 |
| D115,983 | S | | 8/1939 | Bailey |
| 2,186,918 | A | | 1/1940 | Wolf |
| D119,122 | S | | 2/1940 | Bauer |
| 2,259,560 | A | | 10/1941 | Glidden |
| 2,271,211 | A | | 1/1942 | Stockton |
| 2,291,861 | A | | 8/1942 | Astrove |
| 2,391,535 | A | | 12/1945 | Zelano |
| 2,458,004 | A | | 1/1949 | Kerr |
| 2,469,700 | A | | 5/1949 | Petrucelli |
| 2,477,989 | A | | 8/1949 | Maida |
| 2,505,451 | A | | 4/1950 | Weinstock |
| D160,800 | S | | 11/1950 | Mandelbaum |
| 2,551,245 | A | | 5/1951 | Cook |
| 2,585,840 | A | | 2/1952 | Reynolds |
| 2,615,224 | A | | 10/1952 | Shur |
| 2,637,086 | A | | 5/1953 | Philips |
| 2,644,946 | A | | 7/1953 | Menz et al. |
| 2,690,564 | A | | 10/1954 | Kingston et al. |
| 2,700,769 | A | | 2/1955 | Polchinski |
| 2,713,168 | A | | 7/1955 | Bagnato |
| 2,715,226 | A | | 8/1955 | Weiner |
| 2,722,694 | A | | 11/1955 | Bryant |
| 2,800,699 | A | | 7/1957 | Armstrong |
| 2,989,754 | A | | 6/1961 | Bukspan |
| 3,045,243 | A | | 7/1962 | Lash et al. |
| 3,086,215 | A | | 4/1963 | Di Paola |
| 3,102,570 | A | | 9/1963 | Fairchilds |
| 3,153,793 | A | | 10/1964 | Lepore |
| 3,213,465 | A | | 10/1965 | Ludwikowski |
| 3,335,425 | A | * | 8/1967 | Senser ..... 2/96 |
| 3,389,407 | A | | 6/1968 | Morrison |
| 3,448,463 | A | | 6/1969 | Milone |
| 3,449,764 | A | * | 6/1969 | De Fazio et al. ..... 2/96 |
| 3,536,083 | A | | 10/1970 | Reynolds |
| D220,822 | S | | 5/1971 | De Wan |
| 3,638,241 | A | | 2/1972 | Holmes |
| 3,691,564 | A | | 9/1972 | La Marre et al. |
| 3,706,102 | A | | 12/1972 | Grenier |
| 3,761,962 | A | | 10/1973 | Myers |
| 3,771,169 | A | | 11/1973 | Edmund |
| 3,777,309 | A | | 12/1973 | Yeager |
| 3,801,987 | A | | 4/1974 | Thompson, Jr. |
| 3,878,561 | A | | 4/1975 | Winiecki |
| 3,921,224 | A | | 11/1975 | Ingram, III |
| 3,924,273 | A | | 12/1975 | Donovan |
| 3,969,772 | A | | 7/1976 | Pravaz |
| D248,896 | S | | 8/1978 | Hasday et al. |
| 4,112,556 | A | | 9/1978 | Flaum et al. |
| 4,122,553 | A | | 10/1978 | Pitkanen |
| 4,170,793 | A | | 10/1979 | O'Brein |
| 4,185,327 | A | | 1/1980 | Markve |
| 4,195,362 | A | | 4/1980 | Rolando |
| 4,286,337 | A | | 9/1981 | Malouf, Jr. |
| 4,384,369 | A | | 5/1983 | Prince |
| 4,390,996 | A | | 7/1983 | Read |
| 4,397,043 | A | | 8/1983 | Croteau |
| 4,408,356 | A | | 10/1983 | Abrams |
| 4,422,186 | A | | 12/1983 | Loney |
| 4,513,451 | A | | 4/1985 | Brown |
| 4,547,904 | A | | 10/1985 | Long et al. |
| 4,554,682 | A | | 11/1985 | Hillquist |
| 4,563,777 | A | | 1/1986 | Park |
| 4,569,089 | A | | 2/1986 | Nesse |
| 4,608,715 | A | | 9/1986 | Miller et al. |
| 4,665,563 | A | | 5/1987 | Harvey |
| 4,722,099 | A | | 2/1988 | Kratz |
| 4,731,883 | A | | 3/1988 | Foster |
| 4,783,858 | A | | 11/1988 | Chevalier |
| D306,511 | S | | 3/1990 | Jones |
| D308,435 | S | | 6/1990 | Kushitani |
| 4,995,115 | A | | 2/1991 | Ellis |
| 4,996,723 | A | | 3/1991 | Huhn et al. |
| 5,031,244 | A | | 7/1991 | Inagaki |
| 5,097,535 | A | | 3/1992 | Dye et al. |
| 5,105,477 | A | | 4/1992 | Golde |
| 5,105,478 | A | | 4/1992 | Pyc |
| 5,115,516 | A | | 5/1992 | Golde |
| 5,133,086 | A | | 7/1992 | Truitt et al. |
| 5,159,719 | A | | 11/1992 | Aumann |
| D332,342 | S | | 1/1993 | Dye et al. |
| 5,201,075 | A | | 4/1993 | Svetich |
| 5,303,424 | A | | 4/1994 | Cromartie |
| 5,398,343 | A | | 3/1995 | Kuracina |
| 5,444,898 | A | * | 8/1995 | Norvell ..... 24/389 |
| 5,507,042 | A | | 4/1996 | van der Slessen |
| 5,529,823 | A | * | 6/1996 | Aumann ..... 428/53 |
| 5,555,562 | A | | 9/1996 | Holt et al. |
| 5,592,691 | A | | 1/1997 | Ronald |
| 5,603,646 | A | | 2/1997 | Tobias |
| 5,640,715 | A | | 6/1997 | Adams |
| 5,642,526 | A | | 7/1997 | Thompson |
| 5,687,423 | A | | 11/1997 | Ross |
| 5,704,064 | A | | 1/1998 | van der Sleesen |
| 5,718,000 | A | | 2/1998 | Ost et al. |
| 5,752,277 | A | | 5/1998 | van der Sleesen |
| 5,774,891 | A | | 7/1998 | Boyer |
| 5,799,330 | A | | 9/1998 | O'Donoghue-Kitt |
| 5,829,059 | A | | 11/1998 | Covington, Jr. |
| 5,845,336 | A | | 12/1998 | Golde |
| 5,850,634 | A | | 12/1998 | Toombs |
| 5,884,332 | A | | 3/1999 | Snedeker |
| 5,890,225 | A | | 4/1999 | Marschall |
| 5,924,135 | A | | 7/1999 | Worth |
| 5,940,879 | A | | 8/1999 | Whitehouse |
| 5,978,960 | A | | 11/1999 | Wrightman |
| 6,018,819 | A | | 2/2000 | King et al. |
| 6,052,826 | A | | 4/2000 | Tolton |
| 6,070,274 | A | | 6/2000 | van der Sleesen |
| 6,085,353 | A | | 7/2000 | van der Sleesen |
| 6,092,266 | A | | 7/2000 | Lee |
| 6,105,214 | A | | 8/2000 | Press |
| 6,119,270 | A | | 9/2000 | Chou |
| 6,163,883 | A | | 12/2000 | Hong |
| D437,673 | S | | 2/2001 | DesJardins et al. |
| 6,223,349 | B1 | | 5/2001 | Roiser |
| 6,237,152 | B1 | | 5/2001 | Gootrad |
| 6,253,379 | B1 | | 7/2001 | Collier |
| 6,260,196 | B1 | | 7/2001 | van der Sleesen |
| 6,263,510 | B1 | | 7/2001 | Bay et al. |
| 6,263,511 | B1 | | 7/2001 | Moretti |
| 6,298,485 | B1 | | 10/2001 | Heller |
| 6,339,843 | B1 | | 1/2002 | Grilliot et al. |
| 6,339,845 | B1 | | 1/2002 | Burns et al. |
| 6,360,371 | B1 | | 3/2002 | Davey |
| 6,405,377 | B1 | | 6/2002 | Davis |
| 6,421,834 | B2 | | 7/2002 | Kester |
| 6,427,242 | B1 | | 8/2002 | Bush et al. |
| 6,427,294 | B1 | | 8/2002 | Shibaike et al. |
| 6,438,757 | B1 | | 8/2002 | Quinn |
| 6,460,185 | B1 | | 10/2002 | Hardy |
| 6,490,734 | B2 | | 12/2002 | Blauer et al. |
| D479,902 | S | | 9/2003 | Brown |
| 6,651,254 | B1 | | 11/2003 | Chang |
| 6,675,389 | B1 | | 1/2004 | Kublick |
| 6,684,408 | B2 | | 2/2004 | Rindle et al. |
| 6,691,326 | B2 | * | 2/2004 | Hexels ..... 2/457 |
| 6,745,400 | B1 | | 6/2004 | Paciorkowski |
| 6,792,621 | B2 | | 9/2004 | Braun |
| 6,792,622 | B2 | | 9/2004 | Graves |
| 6,795,976 | B1 | | 9/2004 | van der Sleesen |
| 6,802,082 | B2 | | 10/2004 | Watley |
| D498,037 | S | | 11/2004 | Bay |
| 6,848,119 | B2 | | 2/2005 | Crye et al. |
| 6,851,128 | B1 | | 2/2005 | Parrotte |
| 6,854,130 | B2 | | 2/2005 | van der Sleesen |
| 6,868,557 | B1 | | 3/2005 | van der Sleesen |
| 6,883,178 | B2 | | 4/2005 | van der Sleesen |
| 6,941,584 | B1 | | 9/2005 | Matthews |
| 6,961,962 | B1 | | 11/2005 | Lewis |
| 6,968,573 | B2 | | 11/2005 | Silver |
| 7,017,191 | B2 | | 3/2006 | Golde |

| | | | | |
|---|---|---|---|---|
| 7,043,767 | B2 | 5/2006 | Jaeger | |
| 7,062,789 | B1 | 6/2006 | Blackwell | |
| 7,082,648 | B2 | 8/2006 | Morioka et al. | |
| 7,111,328 | B2 | 9/2006 | Bay | |
| 7,162,779 | B2 | 1/2007 | MacHacek | |
| 7,171,695 | B2 | 2/2007 | Braun | |
| 7,181,810 | B2 | 2/2007 | Fernando | |
| 7,191,497 | B2 * | 3/2007 | Butz | 24/389 |
| 7,197,772 | B2 | 4/2007 | Crye et al. | |
| 7,284,282 | B2 | 10/2007 | Bay | |
| D555,878 | S | 11/2007 | Bay | |
| 2002/0130150 | A1 | 9/2002 | Stanley | |
| 2003/0024028 | A1 | 2/2003 | van der Sleesen | |
| 2003/0126667 | A1 | 7/2003 | Braun et al. | |
| 2003/0140399 | A1 | 7/2003 | Golde | |
| 2003/0140404 | A1 | 7/2003 | Golde | |
| 2004/0055069 | A1 | 3/2004 | Clarke Fayle et al. | |
| 2004/0158910 | A1 | 8/2004 | Bay | |
| 2004/0199976 | A1 | 10/2004 | Hunt | |
| 2004/0237168 | A1 * | 12/2004 | Braun | 2/93 |
| 2005/0015843 | A1 | 1/2005 | Roux et al. | |
| 2005/0072825 | A1 | 4/2005 | Barr | |
| 2005/0235392 | A1 * | 10/2005 | Bay | 2/93 |
| 2006/0176660 | A1 | 8/2006 | Amiri | |
| 2007/0083973 | A1 | 4/2007 | Garniewicz | |
| 2007/0094852 | A1 | 5/2007 | Wang | |
| 2008/0040832 | A1 | 2/2008 | Bay | |
| 2008/0060112 | A1 | 3/2008 | Driehorst | |

FOREIGN PATENT DOCUMENTS

| | | |
|---|---|---|
| CA | 2344726 | 10/2002 |
| DE | 517523 | 1/1931 |
| EP | 0 000 095 | 12/1978 |
| EP | 0 034 518 | 1/1981 |
| EP | 0 071 226 | 2/1983 |
| EP | 0 161 564 | 11/1985 |
| EP | 0 412 450 | 2/1991 |
| EP | 0 643 929 | 3/1995 |
| EP | 0 819 389 | 1/1998 |
| EP | 0 870 745 | 10/1998 |
| EP | 0 913 170 | 6/1999 |
| EP | 0 974 277 | 1/2000 |
| EP | 1 329 167 | 7/2003 |
| FR | 1 029 851 | 3/1953 |
| FR | 1 220 511 | 1/1960 |
| FR | 2 094 362 | 1/1972 |
| FR | 2 127 140 | 9/1972 |
| FR | 2 413 052 | 12/1977 |
| FR | 2 460 634 | 7/1979 |
| FR | 2 546 759 | 12/1984 |
| FR | 2 783 138 | 3/2000 |
| GB | 461247 | 2/1937 |
| GB | 2 104 770 | 3/1983 |
| JP | 48-12006 | 2/1973 |
| JP | 49-9409 | 1/1974 |
| JP | 50-11703 | 2/1975 |
| JP | 53-155409 | 12/1978 |
| JP | 55-176314 | 12/1980 |
| JP | 56-15732 | 2/1981 |
| JP | 57-147212 | 9/1982 |
| JP | 58-105410 | 7/1983 |
| JP | 59-4722 | 1/1984 |
| JP | 61-94510 | 6/1986 |
| JP | 7-2417 | 1/1995 |
| JP | 08-284009 | 10/1996 |
| WO | WO 94/00036 | 1/1994 |
| WO | WO 96/39056 | 12/1996 |
| WO | WO 02/01977 | 1/2002 |
| WO | WO 02/060287 | 8/2002 |

OTHER PUBLICATIONS

"Fieldsheer" Advertisement from FIELDSHEERONLINE.COM, showing Fieldsheer Mach 1, Mach 2, Sonic Air, Titanium Air, Highland Suit, Highland 2, Kiri, Manx Pro, Spiga, Thistle, XPack Tech, Cabrio, Latrak jackets; http://store.fieldsheer.com, (Feb. 8, 2003), 24 pages.

"Joe Rocket" Catalog, Spring 2002 (published 2002), Cover page and pp. 4-5, 13, 32 and 35.

"Steve Largent Autographed Football Jersey Mesh", Advertisement from COLLECTIBLES.GOANTIQUES.COM, 1996-2003, (published Feb. 8, 2003), 1 page.

2000 Motorcyle—Joe Rocket® brochure, back page and p. 5 ("Bulldog" jacket), published in 1999.

2001 Kushitani Riding Equipment Collection, 2001, 9 pages.

Accessories Collection, Specialty Sports Limited, http:www.tecknicgearcom/main_r1.htm, Apr. 26, 2000, 4 pages.

AGV Aeromesh Textile Jacket, www.agvsport.com (2004).

Cabela's Master Catalog, Fall 1998, pp. 50-51.

Drawing of Fieldsheer Jacket with removable torso vest (offered for sale or publicly used prior to Feb. 13, 2003), 1 page.

European Search Report for EP 03 29 1709 dated Jun. 15, 2005, 2 pages.

Five photographs of Joe Rocket® "Bulldog" jacket (offered for sale before 2003).

Japanese publications with English translation entitled "Proto War-RJ" citing Kiss Racing (believed to have been published in 2000), 3 pages.

Red Head, Fall 1999, Specialist Catalog, p. 17.

* cited by examiner

GARMENT CLOSURE SYSTEM

BACKGROUND

The present disclosure relates generally to a garment and more specifically to a garment having a closure system which allows for ventilation and protection from the elements.

It is common in the garment industry, particularly in garments that are used by motorcycle riders, to have vent openings to cool the body of the rider in hot weather conditions. Consequently, garments and coats with provisions for ventilation have been developed. Examples of such garments are seen in U.S. Pat. No. 4,608,715, issued Sep. 2, 1986 to Miller et al.; U.S. Pat. No. 5,105,477, issued Apr. 21, 1992 to Golde; and U.S. Pat. No. 5,704,064, issued Jan. 6, 1998 to van der Slessen, which are all incorporated herein by reference.

The garments, however do not provide protection from wet weather conditions, such as rain or sleet, or an otherwise wet environment because the moisture-resistant feature would require a sacrifice of the ventilation feature. For motorcyclists, the windy conditions or normal high-speed motorcycle use make the inclusion of elaborate external protective rain gear or hot, bulky layers undesirable. To open the front closure of the weather resistant garment to provide the ventilation impacts the overall function of the garment because it will flap in the wind behind the motorcyclist and substantially reduce the protection offered by the garment. Accordingly, there is a need for a streamlined system to allow for protection from wet weather conditions and to allow for maximized ventilation.

SUMMARY

In accordance with the present invention, a garment having a ventilated garment closure system including a vented zipper is provided. In another aspect, a first flap is disposed on a first side of a vented zipper, and a second flap disposed on a second side of the vented zipper. In various embodiments, a motorcycle jacket having a ventilated garment closure system is provided. A further aspect of the present disclosure employs a vented zipper having a vented region and a vented zipper width greater than the front zipper width; this advantageously causes the vented region to have a compressed length when the front zipper is in an open position and a relaxed length when the front zipper is in a closed position.

Yet another aspect of the present disclosure includes a motorcycle jacket further including a first flap disposed on a first side of a vented zipper and a second flap disposed on a second side of the vented zipper. The first and second flaps are advantageously operable to be overlapped along the vented region on the interior of the garment to provide a barrier to deter passage of air through the vented region.

In yet another aspect of the present disclosure, a garment includes a vented zipper having a vented mesh region to allow passage of air therethrough and creating a channel on a side of the vented zipper. The channel advantageously displaces the water.

Further areas of applicability will become apparent from the description provided herein. It should be understood that the description and specific examples are intended for purposes of illustration only and are not intended to limit the scope of the present disclosure.

DETAILED DESCRIPTION

Figure 1:
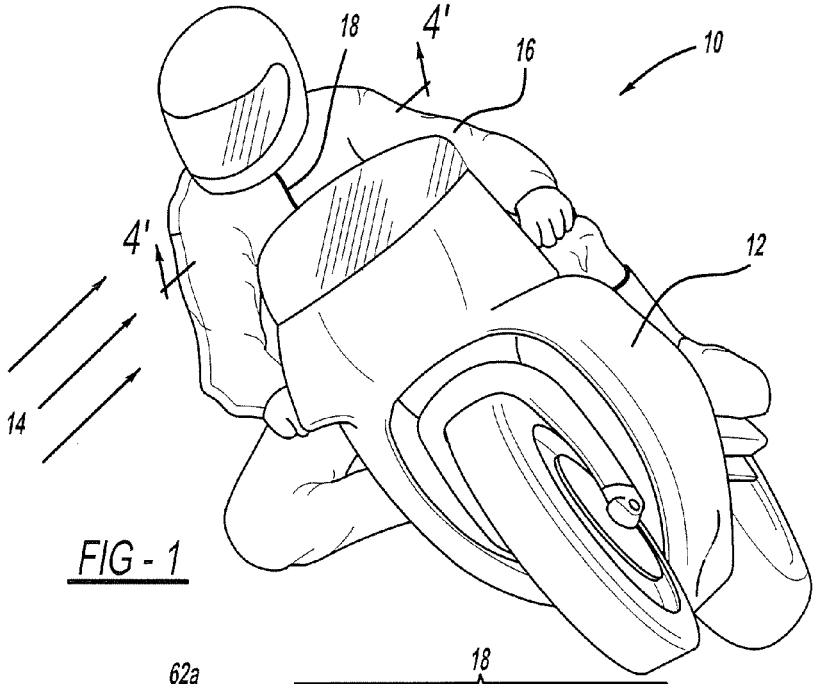
FIG. 1 depicts a perspective view of a garment according to the present teachings, used by a rider on a motorcycle.

Referring to FIG. 1, a motorcycle rider 10 is shown riding a motorcycle 12 and is subjected to a moving air stream indicated by arrows 14 against the front of the rider's body. Rider 10 is wearing a garment 16 having a weather-resistant and ventilated front closure system 18. Garment 16 is depicted as a jacket 20 which covers the arms and torso of rider 10. It is understood that garment 16 can also be a combined jacket/pant suit and can be useful for a user on other motorized vehicles such as an all-terrain vehicle or a snowmobile, and related motorsports, as non-limiting examples.

Figure 3:
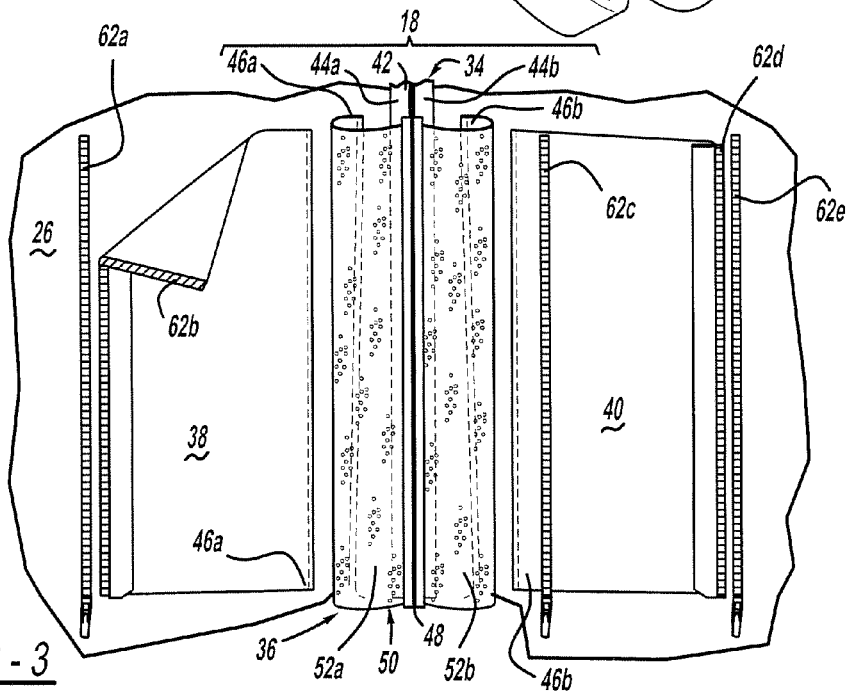
FIG. 3 depicts a fragmentary elevational view forward from the inside of the garment according to the present teachings, showing the vented regions in a compressed condition and the rain flaps secured in an open condition.
Figure 2:
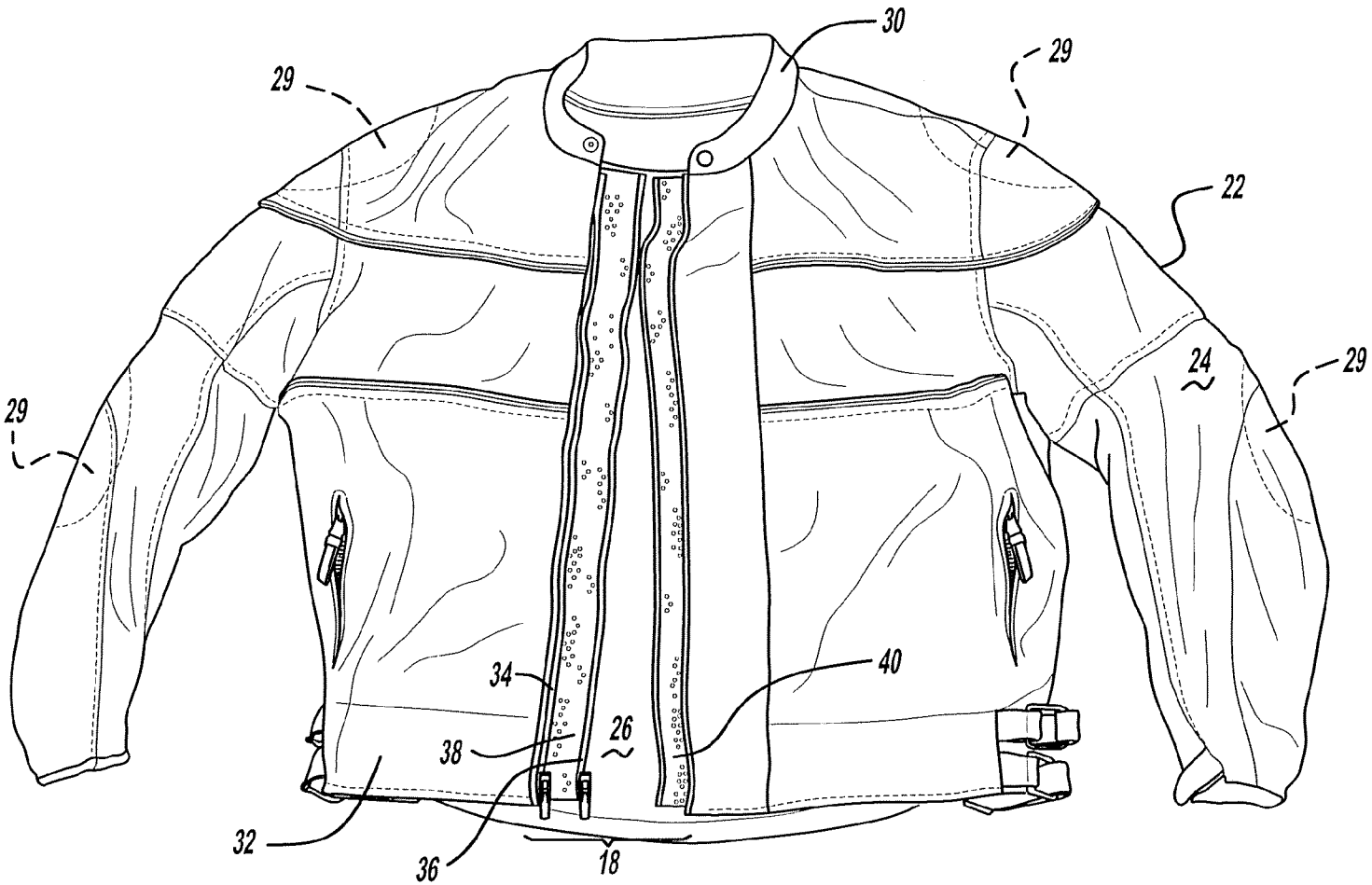
FIG. 2 depicts a front elevational view of the garment according to the present teachings, shown in an open condition.

Turning to FIGS. 2 and 3, garment 16 includes an outer shell 22 having an exterior 24 and an interior 26 and a midliner 28. The midliner 28 is preferably a mesh liner, sewn to interior 26 of outer shell 22. Outer shell 22 is made of a textile, such as a woven or knit material. The woven or knit materials are selected from synthetic fibers or natural fibers, such as cotton, including organic cotton. Other materials can be incorporated into outer shell 22, such as a block copolymer of polyurethane and polyethylene glycol (such as LYCRA) or a para-aramid synthetic fiber (such as KEVLAR), as non-limiting examples, to add to the fit, comfort, performance, or style of garment 16. Garment 16 optionally includes three-dimensional body armor 29 as shown in phantom. Exemplary body armor is similar to that disclosed in U.S. Pat. No. 6,263,510, issued Jul. 24, 2001 to Bay et al. and U.S. Pat. No. 7,111,328, issued Sep. 26, 2006 to Bay et al., which are incorporated herein, in their entirety, by reference.

Front closure system 18 extends substantially or entirely from a neck 30 of garment 16 to a waistband 32 of garment 16. Front closure system 18 provides weather-resistance, such as rain- or snow-resistance, to the torso of rider 10 and is easily converted to provide ventilation to rider 10 without detracting from the external appearance and overall function of the garment while securely maintaining garment 16 on the rider's body. Front closure system 18 optimizes the riding experience by providing versatility for different weather conditions without the bulkiness, heat, and inconvenience of other weather-resistant systems.

As shown in FIGS. 2 and 4*a*-4*c*, front closure system 18 includes a front zipper 34, a vented zipper 36, a first flap 38, and a second flap 40. Front zipper 34 provides the exterior-most closure or front closure of garment 16 and generally extends from neck 30 to waistband 32 of garment 16. Front zipper 34 includes a front zipper closure mechanism 42 and lateral portions 44*a* and 44*b* on either side of front zipper closure mechanism 42. In various aspects, front zipper 34 is an "invisible zipper" whereby portions of closure mechanism 42 remain hidden to simulate the appearance of a continuous front garment material which is not interrupted by a zipper.

Vented zipper 36 is disposed on interior surface 26 of garment 16 at attachment sites 46*a* and 46*b*. Vented zipper 36 extends about front zipper lateral sides 44*a* and 44*b*. Vented zipper 36 includes a vented zipper closure mechanism 48 and a vented region 50 which includes lateral sides 52*a* and 52*b*. Vented region 50 is formed of a mesh material or other material having openings or perforations to facilitate passage of air therethrough.

Vented region 50 has a greater width than front zipper lateral sides 44*a* and 44*b*. Front closure lateral sides 44*a* and 44*b* have a width of a first dimension while vented zipper lateral sides 52*a* and 52*b* have a width of multiple times the width of front closure lateral sides 44*a* and 44*b*. As a non-limiting example, in an embodiment where front closure lateral sides 44*a* and 44*b* have a width of 3 centimeters when front closure mechanism 48 is engaged, vented zipper lateral sides 52*a* and 52*b* have a fully-expanded width of 7 centimeters when vented zipper closure mechanism 48 is engaged and front closure mechanism 48 is not engaged. Thus, vented region 50 is at least twice as wide as front closure lateral sides 44*a* and 44*b*. It is understood that the dimensions of lateral sides 44*a*, 44*b* and 52*a*, 52*b* can be varied and the ratio between the sets of lateral sides can also be varied within the scope of the present teachings although various advantages may not be fully achieved.

Figure 4A:
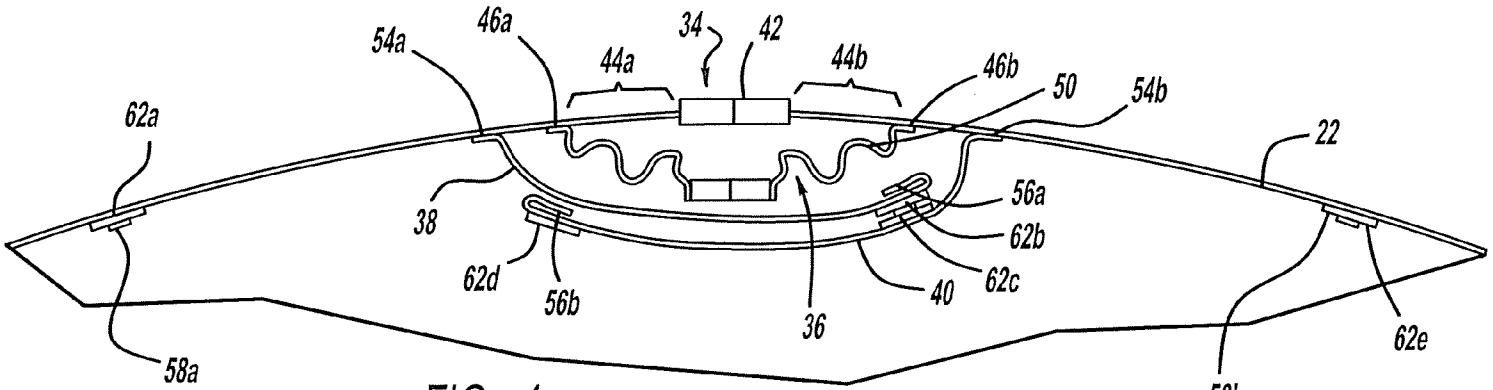
FIGS. 4*a*-4*c* depict cross-sectional views of the garment according to the present disclosure, taken along line 4-4 of FIG. 1, showing different use conditions.
Figure 4B:
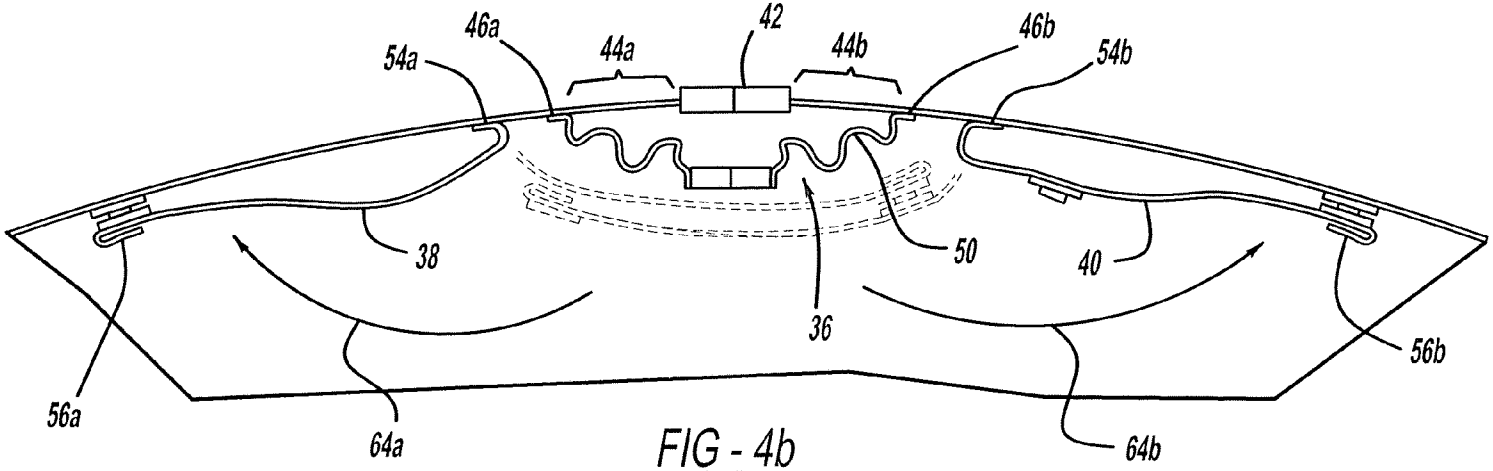
Figure 4C:
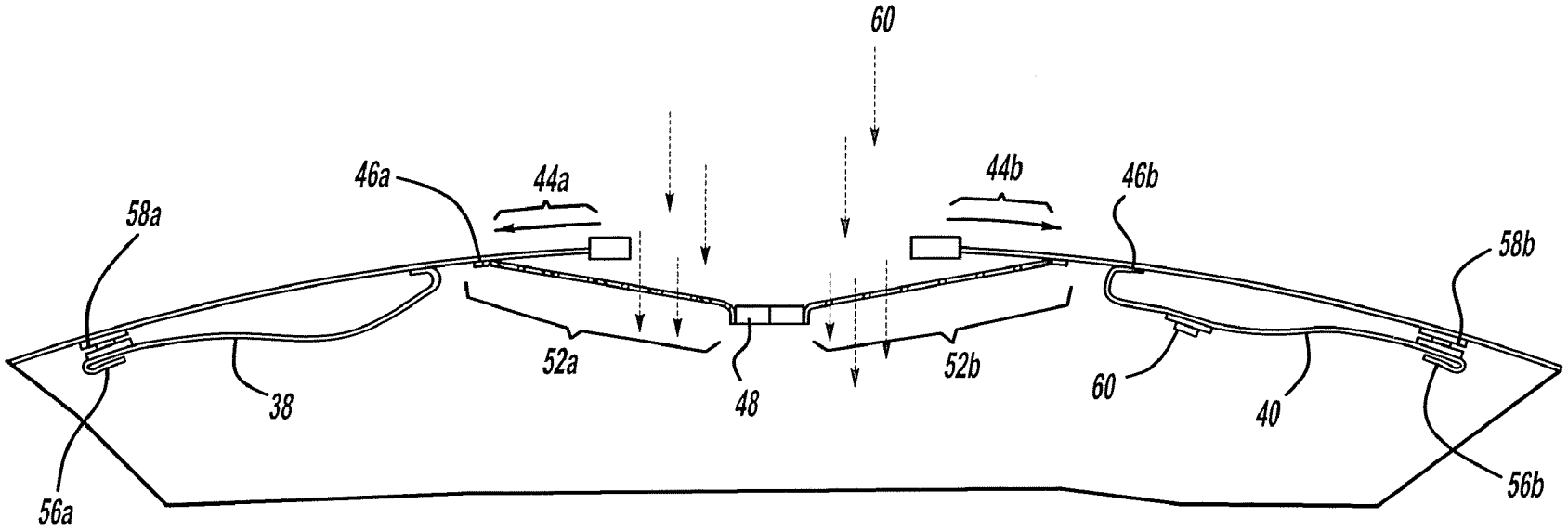

As illustrated by the folds in vented region 50 shown in FIGS. 4*a* and 4*b*, vented region 50 is in a compressed position when front zipper 34 is in the closed position because front zipper lateral sides 44*a* and 44*b* are of a smaller width than vented zipper lateral sides 52*a* and 52*b*. As shown in FIG. 4*c*, when front zipper 34 is disengaged as to separate front closure mechanism 42, vented region 50 is able to extend to its full length, and accordingly, the overall diameter or size of garment 16 is increased across the torso of rider 10.

As shown in FIGS. 3 and 4*a*-4*c*, front closure system 18 further includes first flap 38 and second flap 40 which provide the water-proof, water-barrier, or weather-proofing features. Flaps 38 and 40 extend along an interior surface 26 of garment 16 and are located laterally to attachment sites 46*a* and 46*b* for vented zipper 36. First flap 38 is attached at point 54*a*, and second flap 40 is attached at point 54*b*. Flaps 38 and 40 are able to extend entirely or substantially from neck 30 to waistband 32 of garment 16. Flaps 38 and 40 are made of any suitable textile or polymer material or include a polymer coating, such as a PVC coating. In a preferred embodiment, flaps 38 and 40 include a facing or other stiffening material to enhance the rigidity of the flaps to facilitate placement of the flaps. The facing helps flaps 38 and 40 retain their position is a cost-effective alternative to additional hardware or fasteners within garment 16.

First flap 38 and second flap 40 also include channels 56*a* and 56*b*, respectively which serve as "gutters" to prevent water from wetting rider 10. Should any water permeate front zipper 34 when it is in the closed position, channels 56*a* and 56*b* direct the water away from the rider's body and facilitate removal of the water from garment 16. Channels 56*a* and 56*b* form an obstacle-type, multiple step water removal where any water which engaged but still bypassed channel 56*a* would then engage channel 56*b* for removal from garment 16. This system provides beneficial, multiple-level weather-proofing without burdening the rider with bulky and stuffy weather-protective garments.

As shown in FIGS. 4*a* and 4*b*, respectively, first flap 38 and second flap 40 are secured together so that they overlap and are in a closed position, or first flap 38 and second flap 40 are removably secured to the interior of the jacket at open position attachment points 58*a* and 58*b*, respectively via mateable securing elements 60 to provide an open position. In a preferred embodiment, mateable securing elements 60 are zipper halves such as those depicted as elements 62*a*-62*e*. Mateable securing elements 60 also include combinations such as male and female snaps, buttons and opening, and the like to provide security and ease of use.

In use, the user can choose to have garment 16 in a closed position to provide the weather-resistance or in an open position to provide ventilation. To start, with front zipper 34, vented zipper 36, first flap 38, and second flap 40 in the open positions, the user puts on garment 16. If needed, the user can disengage first flap 38 or second flap 40 from the zippers or snaps at open position attachment points 58*a* and 58*b*.

The user then advances first flap 38 over vented zipper 36 and secures first flap 38 to second flap 40 via zipper halves 62*b* and 62*c*. Next, the user advances second flap 40 behind first flap 38 and secures zipper half 62*d* to mated zipper half 62*a*. The pressure from the user's chest bearing against overlapped flaps 38 and 40 additionally maintains first flap 38 and second flap 40 in the appropriate position to provide the weather-resistance.

Next, the user engages vented zipper closure mechanism 48 to secure vented zipper lateral sides 52*a* and 52*b* together. The user then will fold, compress, or otherwise manipulate vented zipper lateral sides 52*a* and 52*b* to provide sufficient room for front zipper 34 to close over vented zipper 36. The user engages front closure mechanism 42 to restrict vented zipper lateral sides 52*a* and 52*b* and completely close garment 16. Folded vented region 50 remains protected and compressed within the area between front closure zipper 34 and overlapped first and second flaps 38 and 40. The user is now protected from any wet conditions and should any water enter front zipper 34, channels 56*a* and 56*b* sequentially divert the water away from the body of the user.

To provide ventilation, the user first disengages front closure mechanism 42 to separate front lateral sides 44*a* and 44*b*. This reduces the restriction on vented zipper lateral sides 52*a* and 52*b* and will provide a more "relaxed" fit to garment 16. The user then disengages vented zipper closure mechanism 48 to allow access to first flap 38 and second flap 40. After unzipping or unsnapping the connections of first flap 38 and second flap 40. The user can rotate first and second flaps 38 and 40 to their respective "open positions" and removably secure first flap 38 and second flap 40 to the respective open position attachment points 58*a* and 58*b* as illustrated by arrows 64*a* and 64*b* in FIG. 4*b*.

The user then engages vented zipper closure mechanism 48 to secure garment 16 on the user's body. Vented zipper lateral sides 52*a* and 52*b* are fully-expanded and increase the diameter of garment 16 about the user's body and provide the relaxed fit. The relaxed fit and vented regions 50 provide maximum air flow, as indicated by arrows 60, into the vented region 50 and about the user's body for cooling. The force of the wind blowing at the user keeps vented regions 50 fully expanded.

The relaxed fit increases the amount of room available about the user's body without sacrificing the streamlined fit and related function of a motorcycle garment. Front closure system 18 is beneficial as it provides a center front ventilation of garment 16 and a center front weather protection. The center front placement provides maximum protection and cooling benefits through a single region of garment 16.

The description of the present teachings is merely exemplary in nature and, thus, variations that do not depart from the gist of the present teachings are intended to be within the scope of the present teachings. Such variations are not to be regarded as a departure from the spirit and scope of the present teachings.

What is claimed is:

1. A garment having a ventilated garment closure system comprising:

a. an outer shell layer having:

i. an interior surface;

ii. a front zipper defining a main closure; and iii. a vented zipper comprising a vented zipper closure mechanism and two vented zipper lateral sides, each lateral side having two opposing lateral edges, one lateral edge attached to the outer shell layer and the opposing lateral edge attached to the vented zipper closure mechanism, wherein the vented zipper is disposed on the interior surface and adjacent the front zipper and wherein the two vented lateral sides define a vented region to facilitate the passage of air from outside to inside the garment when the front zipper is disengaged and the vented zipper closure mechanism is engaged securing the vented zipper lateral sides, and having a vented zipper width greater than the main closure width to cause the vented region to have a relaxed length when the main closure is in an open position and a compressed length when the main closure is in a closed position; and b. a first flap disposed on a first side of the vented zipper.

2. The garment of claim 1, further comprising a second flap disposed on a second side of the vented zipper.

3. The garment of claim 1, further comprising an internal layer internally attached to the outer shell layer.

4. The garment of claim 1, wherein the first flap further defines a rain channel.

5. The garment of claim 1, wherein the front zipper is a center front zipper of the garment.

6. The garment of claim 1, wherein the front zipper and the vented zipper have substantially the same length.

7. The garment of claim 2, wherein the first and second flaps are operable to be secured in an open position to the interior surface of the garment with a securing element and facilitate passage of air through the vented region.

8. The garment of claim 2, wherein the first and second flaps are operable to be overlapped along the vented region on the interior of the garment to provide a barrier to deter passage of air through the vented region.

9. The garment of claim 1, wherein the first flap further comprises a facing to increase the rigidity thereof.

10. The garment of claim 1, wherein the outer shell is selected from at least one of textiles, woven materials, and knit materials.

11. The garment of claim 9, wherein the outer shell material includes a polymeric coating to increase water-resistance of the garment.

12. A motorcycle jacket having a ventilated garment closure system comprising:

a. an outer shell layer having:

i. an interior and exterior surface defining a garment body diameter;

ii. a main closure having a main closure width; and iii. a vented zipper disposed about the main closure, the vented zipper comprising a vented zipper closure mechanism and two vented zipper lateral sides, each lateral side having two opposing lateral edges, one lateral edge attached to the outer shell layer and the opposing lateral edge attached to the vented zipper closure mechanism, wherein the vented zipper is disposed on the interior surface and adjacent the main closure and wherein the two vented lateral sides define a vented region to facilitate the passage of air from outside to inside the motorcycle jacket when the main closure is disengaged and the vented zipper closure mechanism is engaged securing the vented zipper lateral sides, and having a vented zipper width greater than the main closure width to cause the vented region to have a relaxed length when the main closure is in an open position and a compressed length when the main closure is in a closed position;

b. a first flap disposed on a first side of the vented zipper; and c. a second flap disposed on a second side of the vented zipper, wherein the first and second flaps are operable to be overlapped along the vented region of the garment to provide a barrier to deter passage of air through the vented region.

13. The motorcycle jacket of claim 11, further comprising a securing element, the first and second flaps being operably secured in an open position with the securing element in order to facilitate passage of air through the vented region.

14. The motorcycle jacket of claim 12, wherein the securing elements are selected from at least one of snaps, zippers, and buttons.

15. The motorcycle jacket of claim 12, wherein the securing elements of the first flap can be attached to a mateable securing element on the second flap to cause the first flap and second flap to be fixed together.

16. The motorcycle jacket of claim 11, wherein when the vented region expands to its relaxed width, the garment body diameter is increased.

17. The motorcycle jacket of claim 11, wherein the main closure and the vented zipper extend substantially down a front length of the jacket.

18. The motorcycle jacket of claim 11, wherein the vented region comprises a mesh extension extending from the vented zipper.

19. A waterproof and ventilated closure for a garment comprising:

a front zipper defining a main closure;

an interior surface; and a vented zipper comprising a vented zipper closure mechanism and two vented zipper lateral sides, each lateral side having two opposing lateral edges, one lateral edge attached to an outer shell layer of the garment and the opposing lateral edge attached to the vented zipper closure mechanism, wherein the vented zipper is disposed on the interior surface and adjacent the front zipper, wherein the two vented lateral sides define a vented mesh region to allow passage of air from outside to inside the garment when the front zipper is disengaged and the vented zipper closure mechanism is engaged securing the vented zipper lateral sides, and having a vented zipper width greater than the main closure width to cause the vented mesh region to have a relaxed length when the main closure is in an open position and a compressed length when the main closure is in a closed position;

a first flap defining a first channel disposed on a first side of the vented zipper having a first flap securing element; and a second flap defining a second channel disposed on a second side of the vented zipper having a second flap securing element, wherein the first and second flaps are operable to be overlapped behind the vented region to deter passage of air through the vented region and are secured together by the first flap securing element and the second flap securing element and the first channel and second channel are oriented to displace water.

20. The waterproof and ventilated closure of claim 18, wherein the vented zipper is disposed about the front zipper only on a single side of the front zipper.

21. The waterproof and ventilated closure of claim 18, wherein the first flap and the second flap are reinforced with a facing.

* * * * *